US005769611A

United States Patent [19]

Djordjevic

[11] Patent Number: 5,769,611

[45] Date of Patent: Jun. 23, 1998

[54] HYDRAULIC PRESSURE SUPPLY PUMP WITH MULTIPLE SEQUENTIAL PLUNGERS

[75] Inventor: Ilija Djordjevic, East Granby, Conn.

[73] Assignee: Stanadyne Automotive Corp., Windsor, Conn.

[21] Appl. No.: 709,260

[22] Filed: Sep. 6, 1996

[51] Int. Cl.[6] ..... F04B 1/04; F04B 27/04

[52] U.S. Cl. ..... 417/273; 92/72; 417/462

[58] Field of Search ..... 417/273, 462; 92/72; 123/450

[56] References Cited

U.S. PATENT DOCUMENTS

| | | | |
|---|---|---|---|
| 2,461,121 | 2/1949 | Markham | 417/273 |
| 3,204,561 | 9/1965 | Roosa | 417/273 |
| 4,662,825 | 5/1987 | Djordjevic | 417/206 |
| 4,915,592 | 4/1990 | Hishinuma et al. | 417/462 |
| 4,975,025 | 12/1990 | Yamamura et al. | 417/273 |
| 5,391,059 | 2/1995 | Hallundbaek | 417/273 |
| 5,513,965 | 5/1996 | Nakamura et al. | 417/462 |
| 5,573,386 | 11/1996 | Schmitt et al. | 417/273 |

FOREIGN PATENT DOCUMENTS

| | | | |
|---|---|---|---|
| 0256389 | 2/1988 | European Pat. Off. | 417/273 |

*Primary Examiner*—Timothy Thorpe
*Assistant Examiner*—Ted Kim
*Attorney, Agent, or Firm*—Alix, Yale & Ristas, LLP

[57] ABSTRACT

A plurality of plungers situated radially in a pump body, are sequentially actuated inwardly by a rotatably driven, eccentrically mounted actuating ring. A central valve housing is coaxially received within the body and includes a fuel inlet chamber and a fuel discharge chamber, which are closely axially aligned. The pump body closely engages the valve housing such that radially extending bores in the body and a portion of the valve housing between the inlet and discharge chambers, together define the pumping chambers. All pumping chambers are connected via short passages in the valve housing, to the common inlet chamber and the common outlet chamber. This configuration, by which all fuel passages and associated valves subject to the pumping pressure are within the central valve housing, not only minimizes the dead volume, but keeps all fuel flows confined within a radius that is smaller than the actuator ring sliding radius, i.e., where the actuating ring contacts the outer ends of the plungers or cam shoes at the outer end of the plungers. As a result, engine or other high viscosity (i.e., "lube oil") can be used to lubricate the sliding surfaces.

17 Claims, 8 Drawing Sheets

HYDRAULIC PRESSURE SUPPLY PUMP WITH MULTIPLE SEQUENTIAL PLUNGERS

BACKGROUND OF THE INVENTION

The present invention relates to fuel injection systems for internal combustion engines, and more particularly, to a rotary pump for supplying fuel at high pressure to the accumulator of a common rail fuel injection system.

Conventional diesel fuel injection systems operate at injection pressures under 10,000 psi. For reasons arising primarily from the need to comply with increasingly more stringent engine emissions limits, efforts have been underway to develop injection systems that can operate at pressures above 20,000 psi. Many of these efforts are based on the so-called "common rail" configuration, wherein a pressurization subsystem produces and maintains a fuel pressure over 20,000 psi in an accumulator, and a delivery subsystem distributes and injects pressurized fuel from the accumulator to each engine cylinder.

A number of difficulties have thwarted the development of a commercially successful high pressure fuel injection system. A particularly troublesome difficulty has been the design of a compact pump which can produce two to three times the pressure of a conventional rotary pump, without enlarging the overall exterior dimension, or "envelope", of a conventional pump.

A conventional rotary pump has plungers which reciprocate radially in corresponding pumping chambers. Fuel at inlet pressure is supplied through inlet passages to the pumping chambers, and fuel at outlet pressure is discharged through discharge passages from the pumping chambers. In the case of a pump which has radially outward pressurizing plungers, a rotating actuator periodically slides against the radially inner end of each plunger, periodically forcing the plunger and the fuel charge in the chamber, outwardly. The converse arrangement is present in a pump which has radially inward pressurizing plungers. The main design difficulties for achieving higher pressures, arise from the high torque loads and high friction generated by the sliding of the rotating actuator against the plunger. Another difficulty is the loss of efficiency resulting from power wasted in moving some of the fuel through the passages and chamber without discharging such fuel at the outlet (i.e., the "dead volume" problem).

The torque is a function of (a) the distance between the axis of rotation of the actuator and the sliding contact surface (i.e., friction radius), (b) the pressure in the pumping chamber, and (c) the cross sectional area of the pumping plunger. The lubrication requirements are dictated largely by the coefficient of friction, which depend strongly on variables (a) and (b). It can be readily appreciated that the outwardly pressurizing type of pump has an advantage relative to the inwardly pressurized pump, with respect to variable (a). However, in all outwardly pressurizing pumps known to the inventor, the fuel itself serves as the lubrication medium at the sliding surface. This presents a significant disadvantage, because fuel has a lower lubricity than engine lube oil, by at least a factor of ten. Thus, despite the short friction radius in conventional eccentric actuated, sequentially outward pumping multiple plunger pumps, the maximum achievable pressure is limited by the load capacity of fuel lubricated bushings, supporting the unbalanced pumping reaction force. However, such eccentric actuated pumps have the advantages of quiet operation and a low, uniform drive torque, resulting from the overlapping pumping events.

It has thus been difficult to achieve the desirable combination of significantly higher pressure, while maintaining acceptable torque loads on the bearings and quiet operation.

SUMMARY OF THE INVENTION

It is therefore an object of the present invention to provide a rotary pump which can supply significantly higher hydraulic pressure, at acceptable noise levels, without increasing the exterior size, relative to conventional rotary pumps.

It is a further object of the present invention to provide a rotary pump which can efficiently supply diesel fuel at pressures above 20,000 psi, within an exterior size no greater than, and preferably half the size of, conventional rotary pumps associated with diesel fuel injection systems, while generating acceptable torque loads and noise.

These objects are achieved by the reconfiguration and miniaturization of the functional components of inwardly pressured rotary pumps, to reduce torque and dead volume, while utilizing engine lube oil for lubrication.

In a general aspect of the invention, a plurality of plungers situated radially in a pump body, are sequentially actuated inwardly by a rotatably driven, eccentrically mounted actuating ring. A central valve housing is coaxially received within the body and includes a fuel inlet chamber and a fuel discharge chamber, which are closely axially aligned. The pump body closely engages the valve housing such that radially extending bores in the body and a portion of the valve housing between the inlet and discharge chambers, together define the pumping chambers. All pumping chambers are connected via short passages in the valve housing, to the common inlet chamber and the common outlet chamber.

This configuration, by which all fuel passages and associated valves subject to the pumping pressure are within the central valve housing, not only minimizes the dead volume, but keeps all fuel flows confined within a radius that is smaller than the actuator ring sliding radius, i.e., where the actuating ring contacts the outer ends of the plungers or cam shoes at the outer end of the plungers. As a result, engine or other high viscosity (i.e., "lube oil") can be used to lubricate the sliding surfaces.

The configuration of the plunger bores also reduces the sliding surface radius for a given stroke size of the plunger bores, relative to conventional inwardly pressurized pumps, thereby countering to some extent the disadvantageous torque characteristics of inwardly pressurized pumps. The benefit of this configuration can be enhanced by providing an endless elastomeric spring looped through the plungers and acting outwardly in tension, for biasing the plungers against the actuating ring.

More particularly, the invention is directed to a high pressure hydraulic pump, preferably for use in a diesel fuel injection system, comprising a body having an elongated hub portion defining front and back ends of the body and including a central bore extending from front to back along a central axis. A plurality of plunger bores are spaced uniformly about the axis and extend radially through the hub portion into the central bore. A fuel supply passage also extends through the hub portion into the central bore. A valve housing includes an elongated portion situated in the central bore in close coaxial relation within the hub portion. The valve housing includes a closure wall for each plunger bore, a fuel inlet chamber situated on one axial side of the plunger bores, in fluid communication with the fuel supply passage, and a discharge chamber situated on another axial side of the plunger bores, coaxially extending along the central axis. An inlet check valve fluidly connects the inlet chamber with each of the plunger bores, through a respective closure wall, and an outlet check valve fluidly connects each plunger bore with the discharge chamber, through a respective closure wall. A plurality of plungers, each having radially inner and outer ends, are supported for reciprocal movement in a respective plunger bore. A cam wheel is coaxially supported for rotation around the central axis and a cam actuating ring surrounding the plungers is rigidly mounted on the cam wheel eccentrically relative to the central axis. A cam shoe or the like at the outer end of each plunger is in contact with the actuating ring, for sequentially driving each plunger to a radially inward limit position through a respective plunger bore and thereafter permitting each plunger to move to a radially outward limit position, as the cam gear means is rotated. Fuel is periodically drawn at a relatively low pressure into each plunger bore through a respective inlet check valve as each plunger moves toward its radially outer limit position and fuel is periodically delivered to the discharge chamber at a relatively high pressure from each plunger bore through a respective discharge check valve as each plunger moves to its radially inner limit position.

Preferably, the fuel inlet chamber extends coaxially in the housing portion, such that the closure wall for each plunger bore can be intersected by a respective radius passing from the central axis through the fuel inlet chamber. The discharge chamber has a back wall which is perpendicular to the central axis, and each of the discharge check valves engages a respective valve seat formed in the back wall.

Practitioners in the field will thus appreciate that the inward pumping plungers according to the invention, reduce the required number of high pressure seals and simplify the handling of leak-off through a common hub, thereby facilitating lube oil lubrication, particularly without the need for a bearing dedicated to the pump. Also, the central inlet and discharge valves can be made very compact, thereby minimizing dead volume.

In a representative embodiment, the maximum sliding velocity at 5000 engine RPM is about 33 ft/sec and the maximum shoe load at 1500 bar pressure is about 1250 lb.

BRIEF DESCRIPTION OF THE DRAWINGS

The preferred embodiments of the invention will be described below with reference to the accompanying drawings, in which.

DESCRIPTION OF THE PREFERRED EMBODIMENTS

Figure 1:
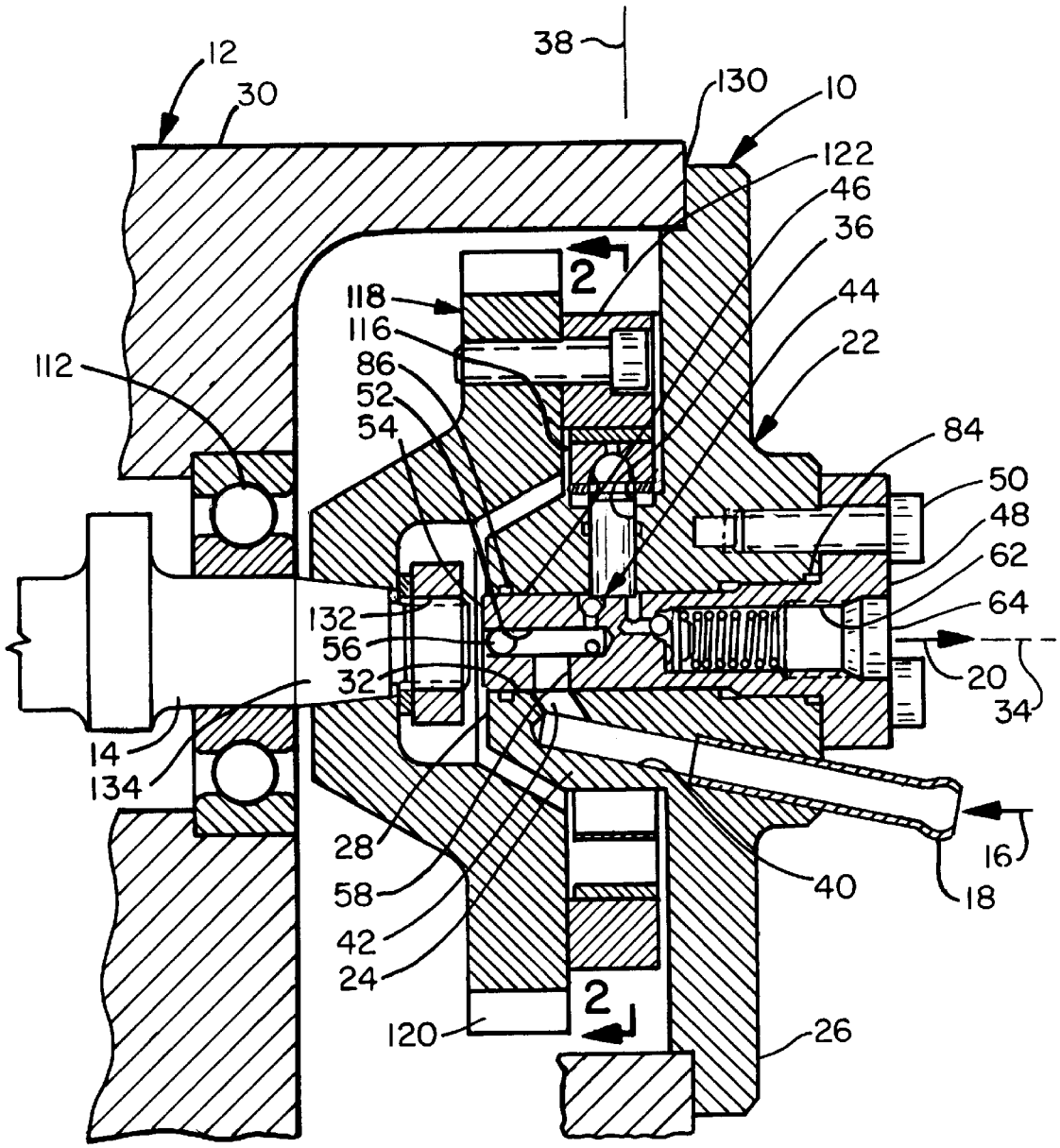
FIG. 1 is a longitudinal section view through a first embodiment of a pump according to the invention, as mounted to an engine valve cover for direct drive by the engine cam shaft.

FIGS. 1–4 show the preferred embodiment of a high pressure pump 10 according to the present invention, mounted on an internal combustion diesel engine 12, as part of a common rail fuel injection system. In this embodiment, the pump 10 is rotatably driven directly by the cam shaft 14 which operates the intake and exhaust valves on the engine. A source of diesel fuel, such as a fuel pump from the fuel tank (not shown), supplies liquid fuel in the direction of arrow 16 at low pressure to the inlet 18 of the pump 10. The high pressure pump 10 delivers fuel at a pressure of at least about 20,000 psi in the direction of arrow 20, to the accumulator (not shown) of the common rail system. It should be understood, however, that the pump according to the invention can be connected to a different source of rotational drive, for delivery of a different kind of liquid at high pressure, for a different purpose.

The pump has a body 22 with an elongated hub portion 24 extending between arbitrary front and back ends 26,28 of the body. The front of the body is preferably formed as flange or the like, for mounting to a rigid support structure such as the engine valve cover 30. The hub 24 has a central bore 32 extending from front to back, along a central axis 34 which in the mounted pump, is on an extension of the rotation axis of the engine cam shaft 14. The hub 24 has a plurality of plunger bores 36 spaced uniformly about the axis intermediate the front and back ends of the body, and extending radially through the hub portion to the central bore. The centerlines of the plunger bores 36 lie on a plane which, for convenience, will be referred to as the pumping plane 38. A fuel supply passage 40 extends obliquely from the front 26 of the body, through the hub portion 24, crossing from the front to the back of the pumping plane 38, and terminating at the central bore through optional further passage 42. Suitable fittings such as 18 can be provided at the front of the fuel supply passage, for connection to the low pressure fuel supply.

A valve housing 44 distinct from the body 22 includes an elongated hub portion 46 situated in the central bore 32 of the body, in close coaxial relation within the hub portion 24, and a flange portion 48 in front of the hub portion, for rigidly engaging the flange portion 26 of the body 22, thereby fixing the valve housing 44 both axially and angularly, relative to the body 22. A plurality of bolts 50, attach the flange portion 48 to the front of the body 22, for this purpose. The flanges on the body and valve housing permit assembly so that the various passages align axially and angularly, and load seals such as 84,86 to prevent leakage of fuel, especially at the front of the pump.

The valve housing hub portion 46 has a fuel inlet chamber 52 formed by an axial blind bore through the back end 54 of the housing, which is then plugged at 56 during fabrication of the pump. The fuel inlet chamber 52 is in fluid communication with the inlet passage, via a short inlet connecting passage 58 in the housing. The front end 60 of the inlet chamber 52, should be as close as possible to the pumping plane 38, for reasons explained more fully below. The valve housing has a discharge chamber 62 formed as an axial blind bore through the front end 48 of the housing. This is adapted to receive a suitable fitting 64 at the front end, for fluidly connecting the discharge chamber to, e.g., the accumulator of the common rail system. The back end or wall 66 of the discharge chamber, approaches the pumping plane 38.

The radially inner ends 68 of the plunger bores 36 are confronted by respective recesses 72 on outer surface 74 on the valve housing. The tolerances are maintained tight enough to establish a fluid seal between the bores 36 and the outer surface 74, such that the recess portion of the surfaces function as closure walls 76 for the bores 70. All the closure walls 76 are intercepted by the pumping plane 38. The closure walls 76 can be shaped if desired, to enhance this sealing relationship. Because the fuel inlet chamber 52 is close to the pumping plane 38, a radius can be drawn from the central axis to the closure wall 76, through the inlet chamber 52. Short passages 70,84 are provided, to fluidly connect the inlet chamber 52 and the discharge chamber 62 to each plunger bore 36 at the closure wall 76.

A piston-like plunger 78 having radially inner and outer ends 80,82, is situated in each of the plunger bores 36, for reciprocal movement. The radial length of each bore will depend on the desired plunger stroke which, along with the bore diameter, defines the maximum volume of fuel which could be forced into the discharge chamber 62 at high pressure upon the plunger reaching its radially inner limit position.

Respective inlet check valve means fluidly connect the inlet chamber 52 with each of the plunger bores 36, through a respective closure wall 76, and respective outlet check valve means fluidly connect each plunger bore 36 with the discharge chamber 62, through the respective closure wall. The inlet check valve means includes a counter bored passage 70 defining an inlet port 90 which in part is fluidly connected to a plunger bore 36 through the closure wall 76 and in part covered by the hub 24, a valve seat 92 which tapers toward the fuel inlet chamber 52, and a ball element 94 situated in the counter bored passage. When the plunger 78 moves radially outward to draw fuel into the plunger bore 36, the ball element 94 moves radially outward into the contact with the hub 24 while maintaining the fluid connection between the inlet port 90 and the plunger bore 36. When the plunger moves radially inward to pressurize fuel in the plunger bore, the ball element 94 moves radially inward into contact with the valve seat 92 to prevent flow from the plunger bore 36 into the fuel inlet chamber 52.

The discharge check valve arrangement is situated in operative relation with each short discharge passage 84. The discharge chamber 62 has a back wall 66 which is perpendicular to the central axis 34, and a valve seat 96 is formed as a recess where each passage penetrates the back wall. A ball element 98 is sealable against a respective seat 96. Means are provided in the discharge chamber, for simultaneously biasing all the ball elements against their respective seats, to prevent opening as the inlet fuel fills the plunger bores. During actuation of the plungers in sequence, the balls 98 will be sequentially forced out of their seats 96 by the very high pressure. Preferably, a piloted coil spring 100 is coaxially situated in the discharge chamber 62 to bear upon a flat disk 102 or the like, which in turn bears on all the ball elements 98. The disk can pivot slightly to accommodate the unseating of one ball, while maintaining the necessary seating force on the other balls. A stop 104 may optionally be provided for limiting the opening movement of the disk 102.

It can be appreciated that the arrangement of the plunger bores 36, closure walls 76, inlet and discharge chambers 52,62, and associated connecting passages with valves, minimizes the dead volume of fuel which is subjected to the pressurization of the plungers, but which cannot be delivered to the discharge chamber. This advantage is achieved while permitting the inner limit position of the plungers during the pressurization stroke to closely approach the central axis 34. This helps minimize the torque radius, i.e., the distance from the central axis 34 to the actuation force applied at the radially outer ends 82 of the plungers 78.

At a radius intermediate the stroke outward limit position of the inner end 80 of the plungers 78 and the stroke inward limit position of the outer end 82 of the plungers, each plunger bore has a fuel leak off groove 106. These grooves draw away any fuel that might pass through the sealing effect of the tight tolerances between the plungers 78 and bores 36, and leading the fuel through the body to a leak off discharge port (not shown). Thus, all fuel in the pumping plane 38 is confined within a radius dictated by the leak off grooves 106. As a result, lube oil can be used to lubricate the plunger actuation surfaces.

The plungers 78 are actuated by a rigid actuating ring 108 which surrounds the plungers and is mounted for eccentric rotation about the central axis 34. The eccentricity drives each plunger inwardly in sequence, preferably via cam shoes 110 or the like, which facilitate the conversion of the rotary motion of the ring 108, into the linear motion of the plungers 78. This conversion gives rise to a severe torque load, which tends to tilt the plunger axis relative to the bore axis, and generates an imbalanced force on the pump drive shaft 14 which rotates the actuating ring. At the very high pumping pressures produced by the present invention, the torque can cause premature deterioration of the bearings 112 which support the pump drive shaft, as well as rob power from the engine. The torque transmitted to the plungers and bearings can be reduced by increasing the lubrication at the sliding contact surface 114 between the shoe and the actuating ring.

Figure 2:
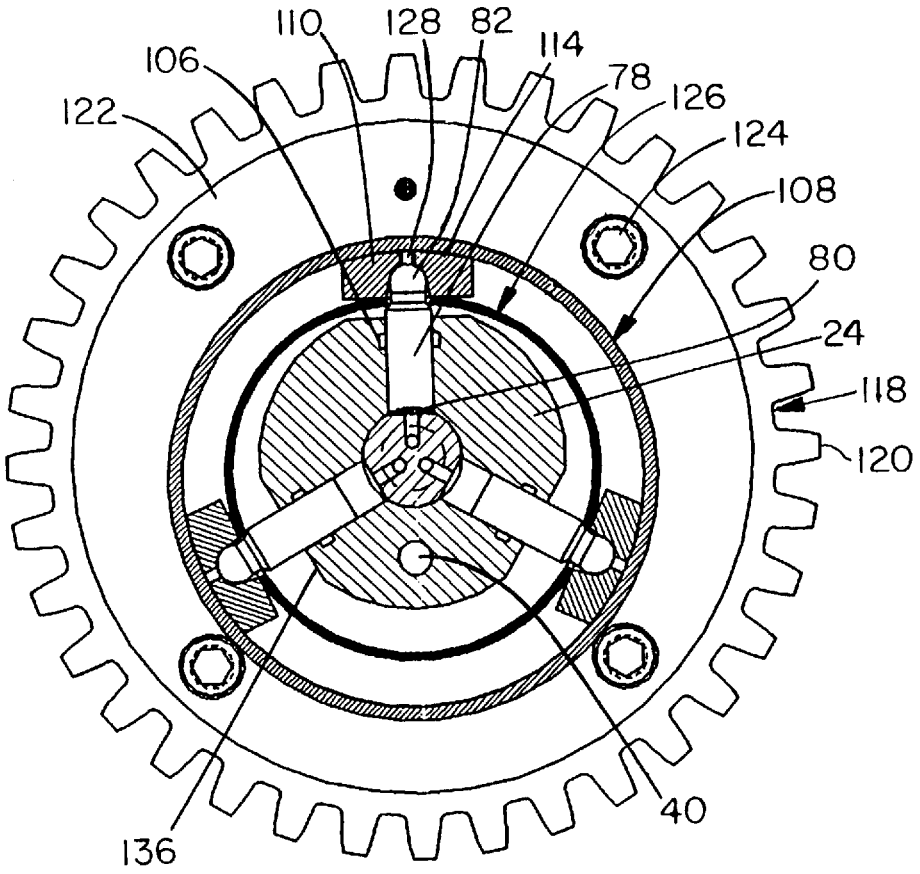
FIG. 2 is a cross section view taken along line 2—2 of FIG. 1.
Figure 3:
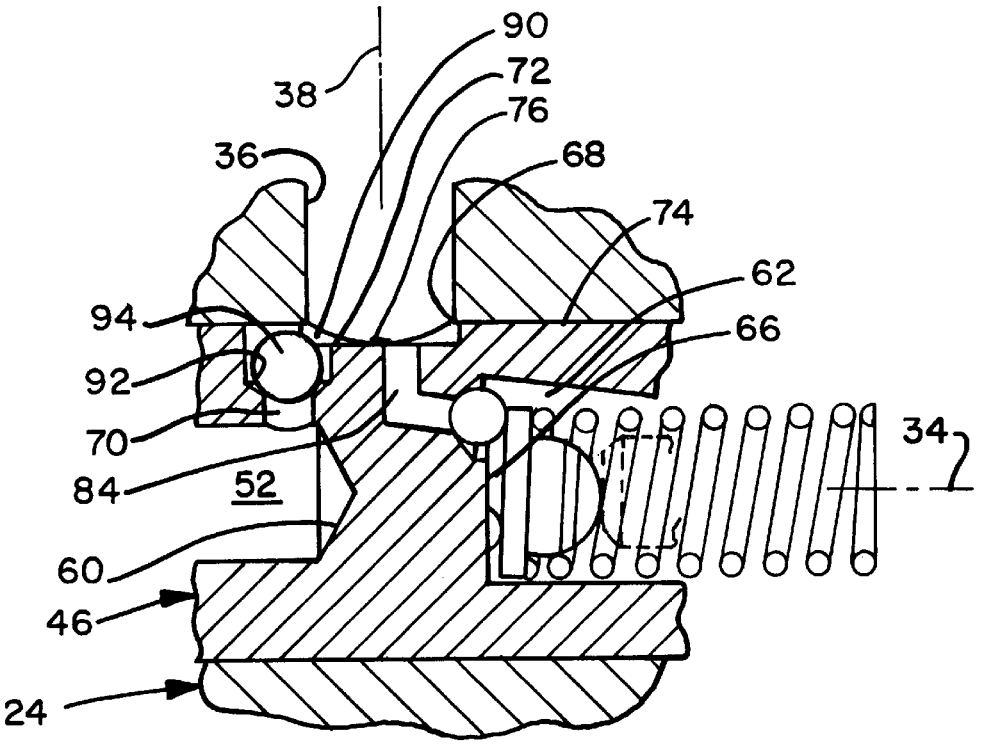
FIG. 3 is an enlarged view of the valve arrangement in the embodiment shown in FIG. 1, with the shown discharge valve open.
Figure 4:
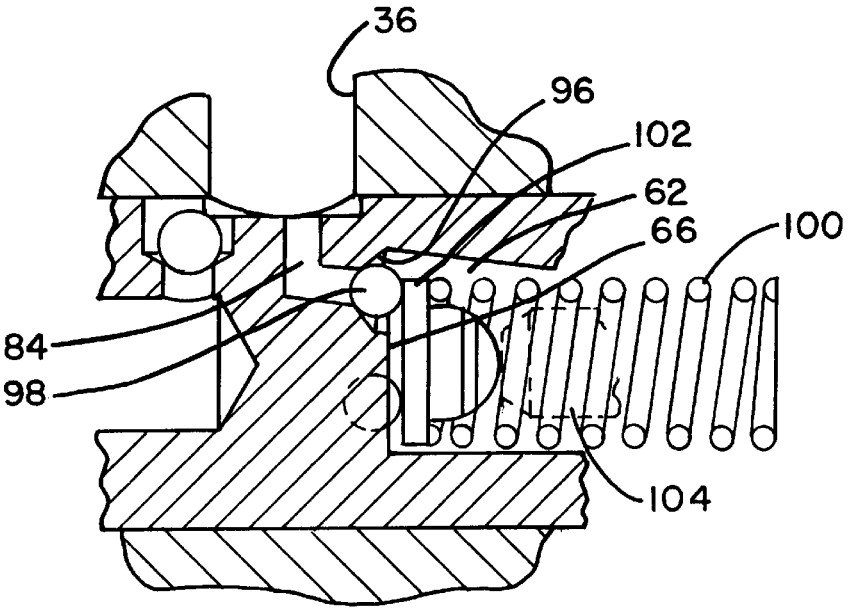
FIG. 4 is an enlarged view of the valve arrangement in the embodiment shown in FIG. 1, with the shown discharge valve closed.

According to the embodiment shown in FIGS. 1 and 2, engine oil or other lube oil, which has a much greater viscosity than diesel fuel, can easily be provided to the sliding contact surface 114. The lube oil is supplied at the back end 28,54 of the body 22 and/or valve housing 44, or at the outer circumference of the actuating ring 108. The lube oil passes through the relatively wide axial tolerances or gaps 116, between the actuating ring and support structure 118 for the actuating ring.

The support structure 118 preferably takes the form of the cam gear that is already present for taking off power from the engine crank shaft to rotate the valve cam shaft 14. The external teeth 120 engage a belt or chain (not shown) which in turn engages teeth on a gear driven by the crank shaft (not shown). A circular collar 122 is rigidly connected via bolts 124 or the like, to the front face of the cam gear 118 in coaxial relation to the cam gear. The actuating ring 108 is rigidly mounted within the collar 122, eccentrically relative to the cam gear axis, so as to bear on the shoes 110.

With the cam shoes 110 in contact with the inner surface 114 of the actuating ring 108 and the outer end 82 of each plunger 78, each plunger is driven to a radially inward limit position through a respective plunger bore and thereafter each plunger must be permitted to move to a radially outward limit position, as the cam gear 118 is rotated. Fuel is thus periodically drawn at a relatively lower pressure from the inlet chamber 62 into each plunger bore 36 through a respective inlet check valve as each plunger moves toward its radially outer limit position and fuel is periodically delivered to the discharge chamber 62 at a relatively high pressure from each plunger bore through a respective discharge check valve as each plunger moves to its radially inner limit position. To assure that each plunger 78 moves to its radially outward limit position, energizer means can be provided, for biasing the plungers outwardly. In a typical arrangement wherein the outer end 82 of the plunger is captured to swivel within the shoe 110, the biasing means can act on the shoe.

Preferably, as shown in FIG. 2, the energizer means is in the form of an elastic ring 126, pre-loaded compressively. The elastic energizing ring 126 circumscribes the pump body hub portion 24 on the pumping plane 38 and maintains a radially outwardly directed bias against the inner sides of all the sliding shoes. The ring is preferably made from a material such as spring steel or Vespel (available from the DuPont Company). In this manner, lube oil can be supplied to the plunger actuating means, on the pumping plane and radially outside of the leakoff grooves. Openings 128 in the shoes provide lube oil to the captured end 82 of the plunger.

In the embodiment of FIG. 1, the flange portion 26 of the body is rigidly mounted to the vehicle, at e.g., 130, providing the only support for the body 22 and valve housing 44 connected thereto. The axial position of the actuating ring 108, collar 122, and cam gear 118 are determined by the rigid engagement 132 of the cam gear 118 to the end 134 of cam shaft 14, which is cantilevered from one of the cam shaft bearings 112. The bearing 112 is rigidly supported within the valve cover 30 or housing. The valve cover serves as a convenient mounting location for the body 22. The cam gear means 118 are thereby operatively connected to the body 22 and valve housing 44, only through the contact at 128 between the actuating ring 108 and the cam shoes 110.

Thus, the subassembly comprising body 22, valve housing 44, plungers 78, shoes 110, and shoe biasing means 126 are fixed axially independently of the axial fixing of the subassembly comprising the cam gear 118, collar 122, and actuating ring 108. In this manner, the space 116 or gap can be assured for providing paths for lube oil flow at the inner circumference of the actuating ring and the outer surface of the hub portion of the body, the latter flow helping to lubricate the radially outer portion of the plungers. Desired lube flow paths in the form of gaps on both axial sides of the actuating ring and shoes can be achieved by providing a smaller axial width for the actuating ring and shoes, than the axial width of the space between the body flange 26 and the cam gear 118.

It can be appreciated by those familiar with this field of technology that a key feature of the present invention, is the small diameter of the eccentric actuating ring 108 (e.g., 0.150 inch), which minimizes the drive force associated with the torque on the sliding shoes 110. As a result, high pressure output of at least 20,000 psi can be achieved in a pump envelope which is no larger than, and can readily be made only about half as large as, conventional hydraulic supply pumps operating at about 7,000 psi discharge pressure. A further key feature, is the arrangement of a single fuel inlet chamber 52, a single fuel discharge chamber 62, and relatively short passages between these chambers and the individual plunger bores 36. With these chambers and passages, and associated valves, all situated within a small diameter valve housing 44, i.e., radially inside of the inward limit position of the plungers 78, very little "dead space" arises. Moreover, these significant advantages are achieved in a configuration which provides smooth torque and quiet operation, due to the sequential actuation.

The minimization of the diameter of the eccentric 108 is facilitated in the preferred embodiment, by the circular energizing ring 126. The cross section of the body hub 24 is substantially circular, except for flattened regions 136 at the exterior, for the emergence of each plunger 78. Although three plungers are shown, a greater number, i.e., 6 or 8, can readily be achieved in accordance with the present specification. The width of the energizing ring 126 in the axial direction, is preferably approximately equal to that of the shoes 110. The energizing ring has holes or slots, which are penetrated by the outer ends 82 of the plungers, such that the plungers engage and capture the energizing ring, not unlike a sprocket engages mating holes on a tape or paper feed arrangement. The energizing ring 126 contacts all shoes 110 simultaneously. Therefore the dynamics of one shoe influences the dynamics of all other shoes, in a manner that requires a relatively small dynamic radius at the maximum outward position of the actuating shoe, relative to incorporation of a more conventional shoe energizing scheme. In a conventional spring energizing scheme, each spring has a stroke equal to two times the eccentricity.

Figure 5:
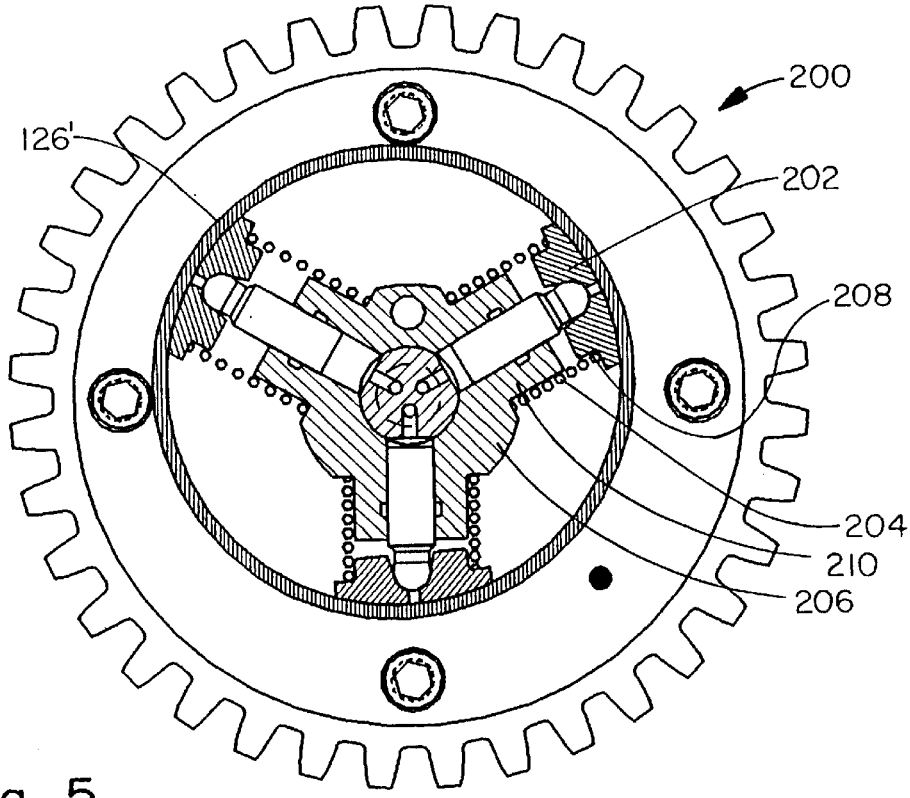
FIG. 5 is a view similar to FIG. 2, showing the incorporation of conventional coil springs for biasing the cam shoes of the plungers, against the actuation ring.

FIG. 5 shows a second embodiment of an energizing arrangement 200, which is functionally similar to that of FIG. 2, except that the energizing means for the cam shoes 202, incorporates conventional coil return springs 204. Because these springs must be piloted, both the shoes and the hub 206, have projections 208,210 which extend radially toward each other. This increases the overall radius to the actuating ring 126', relative to the embodiment shown in FIG. 2. Although one could maintain the same outer diameter of the body hub 206 shown in FIG. 5 as the body 24 shown in FIG. 2, this would require a reduction in the solid cross section and thereby weaken the body relative to the embodiment of FIG. 2.

Figure 6:
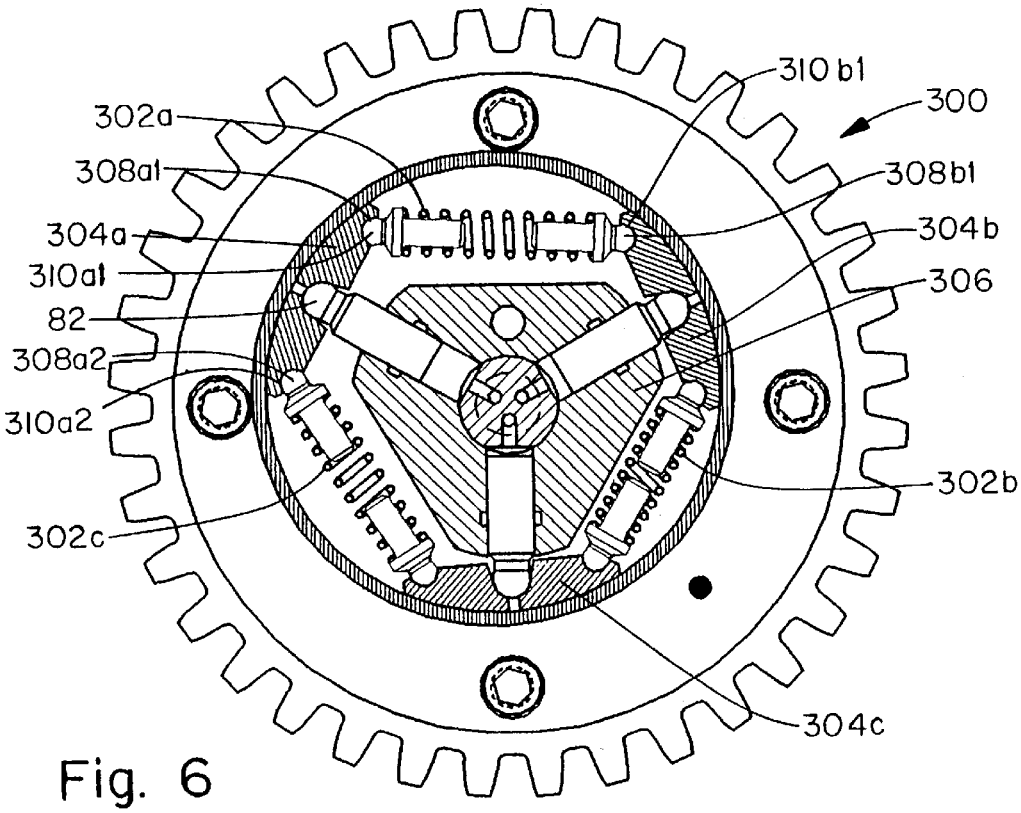
FIG. 6 is a view similar to FIG. 2, showing another arrangement for biasing the cam shoes of the plungers against the actuation ring.

FIG. 6 shows a third embodiment 300 of the cam shoe energizing means, which is also novel in this context, relative to utilization of the conventional return springs of the type shown in FIG. 5. In this arrangement, the energizer means includes discrete, piloted coil springs 302*a,b,c* spanning adjacent sliding shoes 304*a,b,c* for generating a linearly directed tension force between the adjacent shoes. The tips 308*a*1, 308*b*1 of each pilot are rounded and engage respective rounded seats 310*a*1, 310*b*1 in adjacent shoes 304*a*, 304*b*. Thus, a pair of seats such as 310*a*1, 310*a*2 are provided on either side of the engagement of the plunger end 82, on each shoe. The net force component on each shoe is radially outward, as desired, but the necessity for piloting the springs radially along the plunger, is avoided. However, the embodiment of FIG. 6 would still require a slight reduction in solid cross section of the body 306, relative to the embodiment of FIG. 2.

Figure 7:
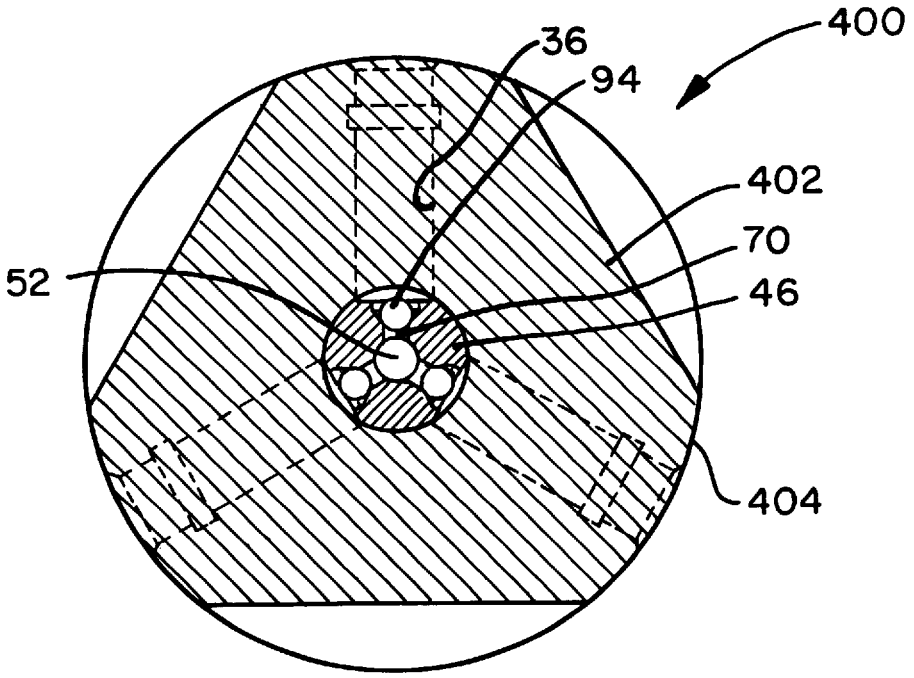
FIG. 7 is an enlarged cross section view through an inlet valve arrangement similar to the embodiment shown in FIG. 1.
Figure 8:
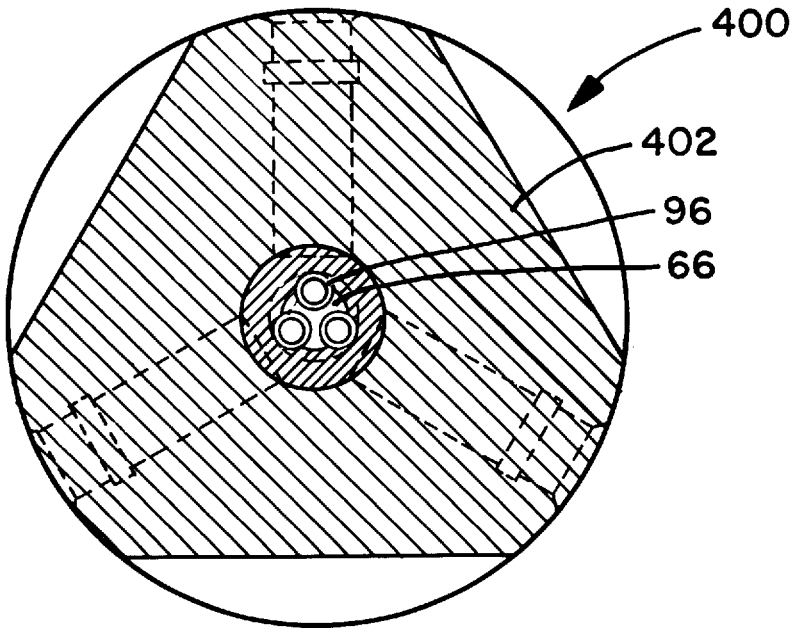
FIG. 8 is an enlarged cross section view through a discharge valve arrangement similar to the embodiment shown in FIG. 1.

It should be appreciated that the body hub cross section can take a variety of shapes. FIGS. 7 and 8 show an embodiment 400 having a hub 402 cross section of substantially triangular shape with rounded comers 404 at the vertices, where the plunger bores 36 penetrate the body. FIG. 7 is a cross section view through the body and hub, which more clearly reveal the captured inlet check valves, and FIG. 8 shows the triple seat discharge check valve, both of which operate according to the description set forth above with respect to FIGS. 1–4.

Figure 9:
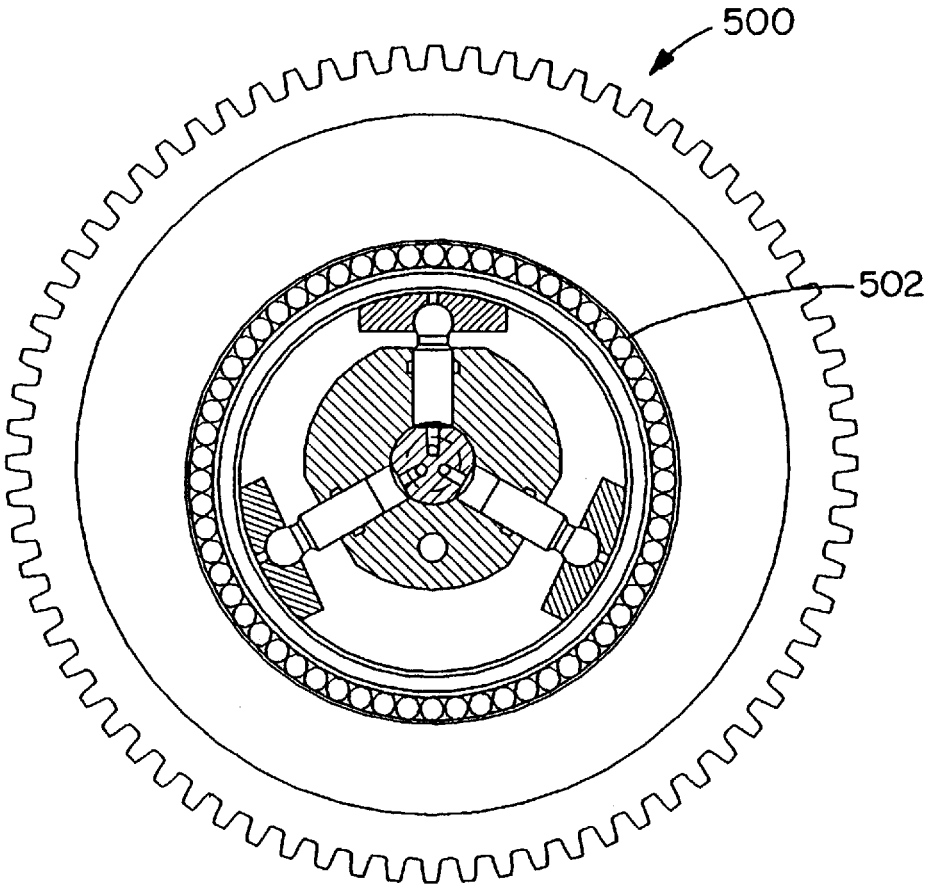
FIG. 9 is another view similar to FIG. 2, showing a needle bearing rather than a journal bearing.

FIG. 9 shows a variation 500 of the embodiment of FIGS. 1 and 2, wherein a needle bearing 502 is substituted for the actuating ring. This may be necessary to accommodate excessive friction loads and associated heat generation.

Figure 10:
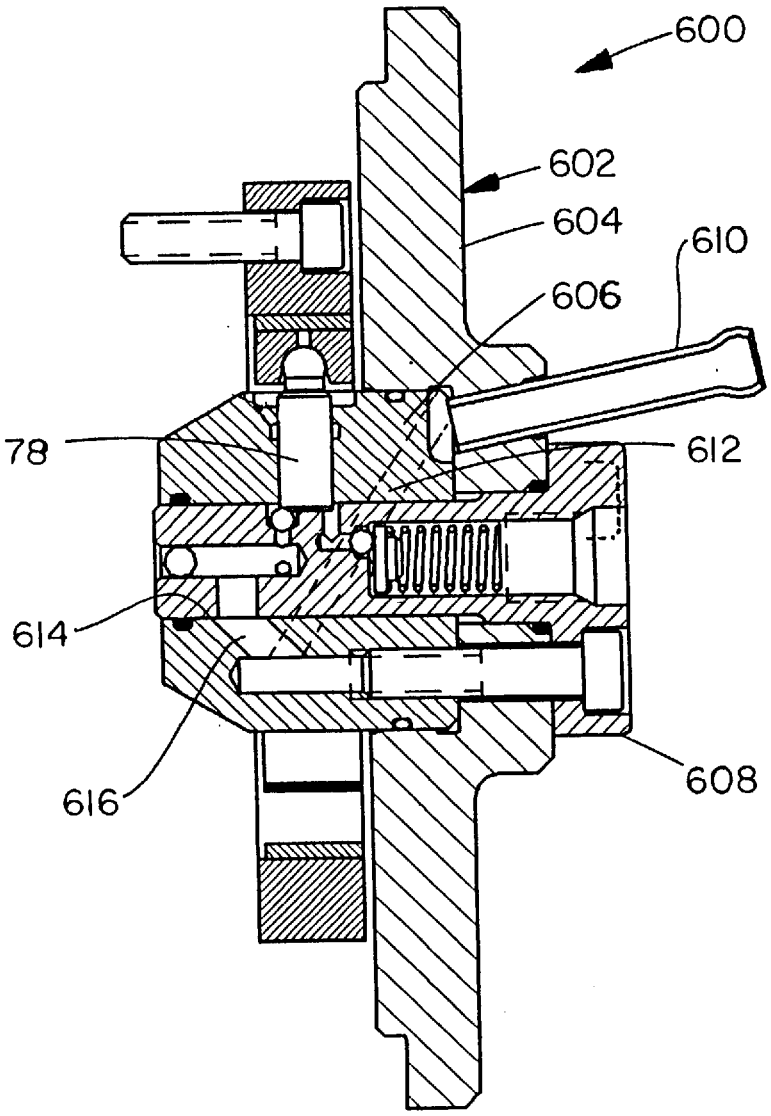
FIGS. 10 and 11 are longitudinal section and end views, respectively, of a pump having an alternative body configuration according to the invention, shown without the engine components.
Figure 11:
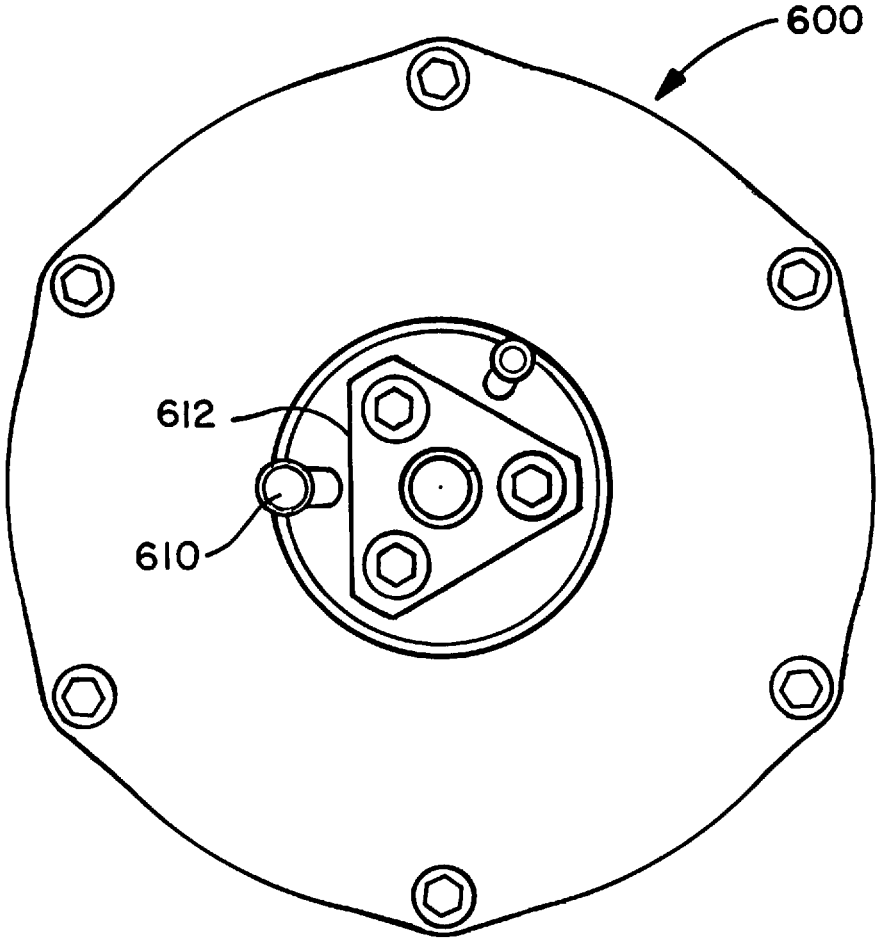

FIGS. 10 and 11 show another embodiment 600 of the pump, which operates in accordance with the same principles as that described with respect to FIGS. 1 and 2, but simply has a different body configuration. In particular, in this embodiment, the body 602 has a relatively large diameter flange portion 604 at the front end, and a relatively small diameter sleeve portion 606 sealed and retained coaxially against the flange portion. The sleeve portion 606 constitutes at least a part of the elongated hub portion of the body. Only the sleeve 606 and valve body 608 require high strength, and are preferably made of Nitraloy. The flange 604 can be made from aluminum plate. The inlet 610 fluidly connects to a body inlet passage 612 (shown partly in phantom), which in turn is fluidly connected to the central bore 614 via further passage 616.

I claim:

1. A pressure diesel fuel supply pump comprising:

a body having, an elongated hub portion defining first and second ends of the body and including a central bore extending between the first and second ends, along a central axis, a plurality of plunger bores spaced uniformly about the axis and extending radially through the hub portion into the central bore, and a fuel supply passage extending through the hub portion into the central bore;

a valve housing distinct from said hub portion and having an elongated portion extending along a valve housing axis and situated in the central bore in close coaxial relation within the hub portion, and including, a closure wall for each plunger bore, a fuel inlet chamber situated on one axial side of the plunger bores, and in fluid communication with the fuel supply passage, inlet check valve means for fluidly connecting the inlet chamber with each of the plunger bores, through a respective closure wall, a discharge chamber situated on another axial side of the plunger bores, and coaxially extending along the central axis, outlet check valve means for fluidly connecting each plunger bore with the discharge chamber, through a respective closure wall;

a plurality of plungers, each having radially inner and outer ends, and supported for reciprocal movement in a respective plunger bore;

cam gear means coaxially supported for rotation around the central axis;

a cam actuating ring rigidly mounted on the cam gear means eccentrically relative to the central axis, and surrounding the plungers;

cam shoe means in contact with the actuating ring and the outer end of each plunger, for sequentially driving each plunger to a radially inward limit position through a respective plunger bore and thereafter permitting each plunger to move to a radially outward limit position, as the cam gear means is rotated;

whereby fuel is periodically drawn at a relatively low pressure into each plunger bore through a respective inlet check valve means as each plunger moves toward its radially outer limit position and fuel is periodically delivered to the discharge chamber at a relatively high pressure from each plunger bore through a respective discharge check valve means as each plunger moves to its radially inner limit position.

2. The pump of claim 1, wherein the fuel inlet chamber extends coaxially in the valve housing elongated portion, such that the closure wall for each plunger bore is intersected by a respective radius passing from the central axis through the fuel inlet chamber.

3. The pump of claim 1, wherein the discharge chamber has a back wall which is perpendicular to the central axis, and each of the discharge check valve means includes a respective valve seat formed in said back wall.

4. The pump of claim 3, wherein each of the discharge valve means includes a ball element sealable against a respective seat, and means are provided in the discharge chamber, for simultaneously biasing all the ball elements toward their respective seats, while permitting one ball element to unseat under the influence of said relatively high pressure in one plunger bore while the other ball elements remain sealingly seated.

5. The pump of claim 1, wherein the cam gear means is connected adjacent the second end of the body, to a rotatable drive shaft which is coaxially situated on the central axis.

6. The pump of claim 5, wherein said cam gear means is operatively connected to the body and valve housing, only through the contact between the actuating ring and the cam shoes.

7. The pump of claim 6, wherein the drive shaft is supported in roller bearings within a shaft housing, said body is rigidly attached to the shaft housing, and said valve housing is rigidly attached to the body.

8. The pump of claim 2, wherein the closure wall for each plunger bore is formed as an exterior recess in the valve housing.

9. The pump of claim 8, wherein each of the inlet check valve means includes, a counter bored passage defining an inlet port which in part is fluidly connected to a plunger bore through the closure wall and in part covered by the hub, and a valve seat which tapers toward the fuel inlet chamber, and a ball element situated in the counterbored passage such that when the plunger moves radially outward to draw fuel into the plunger bore, the ball element moves radially outward into contact with the hub while maintaining said fluid connection between the inlet port and the plunger bore, and when the plunger moves radially inward to pressurize fuel in the plunger bore, the ball element moves radially inward into contact with the valve seat to prevent flow from the plunger bore into the fuel inlet chamber.

10. The pump of claim 1, wherein the body has a relatively large diameter flanged portion at the first end and a relatively small diameter sleeve portion sealingly retained coaxially against said flanged portion, said sleeve portion constituting at least a part of said elongated hub portion of the body.

11. The pump of claim 1, wherein the cam shoe means includes a sliding shoe for each plunger, having an inner side engaging the outer end of the plunger and an outer side in sliding contact with the actuating ring, and energizer means for biasing the sliding shoes outwardly.

12. The pump of claim 11, wherein the energizer means is in the form of an elastic ring pre-loaded compressively, said elastic ring circumscribing the valve housing and maintaining a radially outwardly directed bias against the inner sides of all the sliding shoes.

13. The pump of claim 11, wherein the energizer means includes discrete spring means spanning adjacent sliding shoes for generating a tension force between said adjacent sliding shoes.

14. A hydraulic pressure supply pump comprising:

a body having, an elongated hub including a central bore along a central axis, a plurality of plunger bores spaced uniformly about the axis and extending radially through the hub into the central bore, said plunger bores having respective centerlines which all fall on a common pumping plane oriented perpendicularly to the central axis, leak off means including at least one leak off groove in each the plunger bores and leak off passage means leading from each groove through the body to a leak off discharge port, and a fuel supply passage extending through the hub into the central bore;

a plurality of plungers, each having radially inner and outer ends, and situated for reciprocal movement in a respective plunger bore, along the pumping plane;

a valve housing having an outer surface and situated in the central bore so that the outer surface is in close coaxial relation within the hub, said valve housing further including, wall means at the outer surface of the valve housing, defining a closure wall for each plunger bore, all the closure walls being intercepted by the pumping plane, a fuel inlet chamber in fluid communication with the fuel supply passage, inlet check valve means for fluidly connecting the inlet chamber with each of the plunger bores, through a respective closure wall, a discharge chamber, and outlet check valve means for fluidly connecting each plunger bore with the discharge chamber, through a respective closure wall;

means for rigidly attaching the body to the valve housing to form a subassembly;

means for mounting the subassembly to a rigid, stationary support;

plunger actuating means for sequentially driving each plunger along the pumping plane to a radially inward limit position through a respective plunger bore and thereafter permitting each plunger to move to a radially outward limit position whereby fuel is periodically drawn at a relatively low pressure into each plunger bore through a respective inlet check valve means as each plunger moves toward its radially outer limit position and fuel is periodically delivered to the discharge chamber at a relatively high pressure from each plunger bore through a respective discharge check valve means as each plunger moves to its radially inner limit position; and means for supplying lube oil to the plunger actuating means, on the pumping plane and radially outside of the leakoff grooves.

15. The pump of claim 14, wherein the fuel inlet chamber extends coaxially in the valve housing, such that the closure wall for each plunger bore is intersected by a respective radius passing from the central axis through the fuel inlet chamber.

16. The pump of claim 14, wherein the discharge chamber has an end wall which is perpendicular to the central axis, and each of the discharge check valve means includes a respective valve seat formed in said end wall.

17. The pump of claim 14, wherein the plunger actuating means includes an actuating surface which is rotated eccentrically relative to the central axis.

* * * * *

UNITED STATES PATENT AND TRADEMARK OFFICE

CERTIFICATE OF CORRECTION

PATENT NO. : 5,769,611

DATED : June 23, 1998

INVENTOR(S) : Ilija Djordjevic

It is certified that error appears in the above-identified patent and that said Letters Patent is hereby corrected as shown below:

Column 9, line 15, insert --high-- before "pressure".

Signed and Sealed this

Seventh Day of December, 1999

*Attest:*

Q. TODD DICKINSON

*Attesting Officer*

*Acting Commissioner of Patents and Trademarks*